US005788459A

United States Patent [19]

Neumann et al.

[11] Patent Number: 5,788,459

[45] Date of Patent: Aug. 4, 1998

[54] SUPPORT SHELF FOR VERTICAL STACKING SYSTEM

[75] Inventors: Irving H. Neumann, Somerville, N.J.; Timothy Goszka, Easton, Pa.; Gregory Balcerek, Wayne; Michael Harmon, Manville, both of N.J.

[73] Assignee: Butler SMC, Somerset, N.J.

[21] Appl. No.: 679,767

[22] Filed: Jul. 15, 1996

[51] Int. Cl.[6] ..... B65G 57/02

[52] U.S. Cl. ..... 414/789.9; 414/924

[58] Field of Search ..... 414/790, 790.1, 414/790.8, 924, 926

[56] References Cited

U.S. PATENT DOCUMENTS

| | | | |
|---|---|---|---|
| 3,749,395 | 7/1973 | Bazzarone et al. . | |
| 4,296,684 | 10/1981 | Wangermann | 100/292 |
| 4,541,763 | 9/1985 | Chandhoke et al. | 414/790.8 X |
| 4,723,883 | 2/1988 | Smith . | |
| 5,190,281 | 3/1993 | Cardenas | 271/198 |
| 5,249,917 | 10/1993 | Neumann et al. | 414/799 |
| 5,322,272 | 6/1994 | Benz et al. | 414/790.8 X |
| 5,460,479 | 10/1995 | Neumann et al. | 414/789.5 |

FOREIGN PATENT DOCUMENTS

| | | | |
|---|---|---|---|
| 61-55064 | 3/1986 | Japan | 414/790.8 |
| 295365 | 12/1988 | Japan | 414/790.8 |

*Primary Examiner*—Janice L. Krizek

*Attorney, Agent, or Firm*—Mathews, Collins, Shepherd & Gould, P.A.

[57] ABSTRACT

The present invention relates to a vertical stacking system having a shelf support assembly for supporting the edge surface of the bottom surface of the bottom most signature in a stack of signatures. The shelf support assembly is positioned perpendicular and out of the path of a sliding support which receives the forming stack. The shelf support assembly is moved towards the forming stack and away from the formed stack at the same time forks of the sliding support are extended and retracted for receiving and releasing the stack of signatures.

11 Claims, 7 Drawing Sheets

SUPPORT SHELF FOR VERTICAL STACKING SYSTEM

BACKGROUND OF THE INVENTION

1. Field of the Invention

The present invention relates to a vertical stacking system in which an adjustable shelf support provides support of the edges of the bottom surface of the bottom most signature of a stack of signatures for aiding in aligning different sized signatures during formation of the stack.

2. Description of Related Art

Conventional vertical stacking machines have a vertical stacking support wall which supports the major plane of signatures. The term vertical is used to indicate that the stack is formed with the stack axis vertical or at an angle to the horizontal, typically at an angle greater than 45° and most commonly at an angle between 45° to 75°. In the vertical stacking machine the forming stack rests against the vertical support wall.

Vertical stackers disclosed in the art comprise a vertical stacking table having the vertical support wall. The vertical signature support wall extends from a feed end to a discharge end. The vertical signature support is nominally vertical, but typically at an angle of from 1° to 45° to the vertical. In this way the vertical stacking table rests against the vertical support wall. The vertical stacking table has a sliding signature support fork which can translate up and down along the vertical support wall. The signature support fork can be transverse to and extend from the vertical signature support wall. There can be a feed fork assembly which supports the oncoming signatures as the stack begins to form. The forming stack is transferred from the feed fork to the primary fork. The formed stack on the primary support fork is removed to a bundling and strapping apparatus where the stack is compressed and strapped to form a bundle.

U.S. Pat. No. 5,460,479, issued to a common assignee of this disclosure, describes a vertical stacking machine having a support plane intersecting the vertical support wall. The support plane is preferably a fork having prongs protruding through spaces between rollers forming the vertical support wall. The upper surface of the prongs support the stack formed of each successive signature being deposited on the preceding signature. The support plane moves vertically downward until directly above a primary support having an end board thereon. Thereafter, the forks are retracted and the base of the stack is deposited on the end board.

The above described prior art has the shortcoming that it can be difficult to arrange the signatures on the forks and that the different size signatures are often not adequately supported by the forks resulting in the product being damaged before or during transfer to the end board.

SUMMARY OF THE INVENTION

The present invention relates to a vertical stacking system having a shelf support assembly positioned adjacent the side or sides of a stack of signatures forming on a vertical support plane. The shelf support assembly includes a support plate and means for moving the support plate towards and away from the forming stack of signatures. During stacking of the signatures the support plate is moved towards the stack of signatures until the plate supports the bottom edge surface of the bottom signature of the stack of signatures. Upon completion of the stack of signatures, the support plate is moved away from the formed stack of signatures for transferring the stack to an end board or the next apparatus in the signature assembly procedure.

The shelf support assembly is positioned perpendicular and out of the path of a sliding support assembly which receives the forming stack. Typically, the sliding support assembly includes a plurality of forks which are extended for supporting the forming stack and retracted for depositing the formed vertical stack on the end board or the next apparatus in the assembly procedure. Preferably, the shelf support assembly moves the support plate towards the forming stack and away from the forming stack at the same time as the forks are respectively extended and retracted from the stack. The support of the bottom edge of the stack by the shelf support assembly provides additional support for different sized stacks which may not be adequately supported by the sliding support assembly alone. A common solenoid valve can be used for moving the shelf assembly towards and away from the stack and extending and retracting the sliding support assembly at the same time.

The invention will be more fully described by reference to the following drawings.

DETAILED DESCRIPTION OF THE PRESENT INVENTION

During the course of this description like numbers will be used to identify like elements according to the different figures which illustrate the invention.

Figure 1:
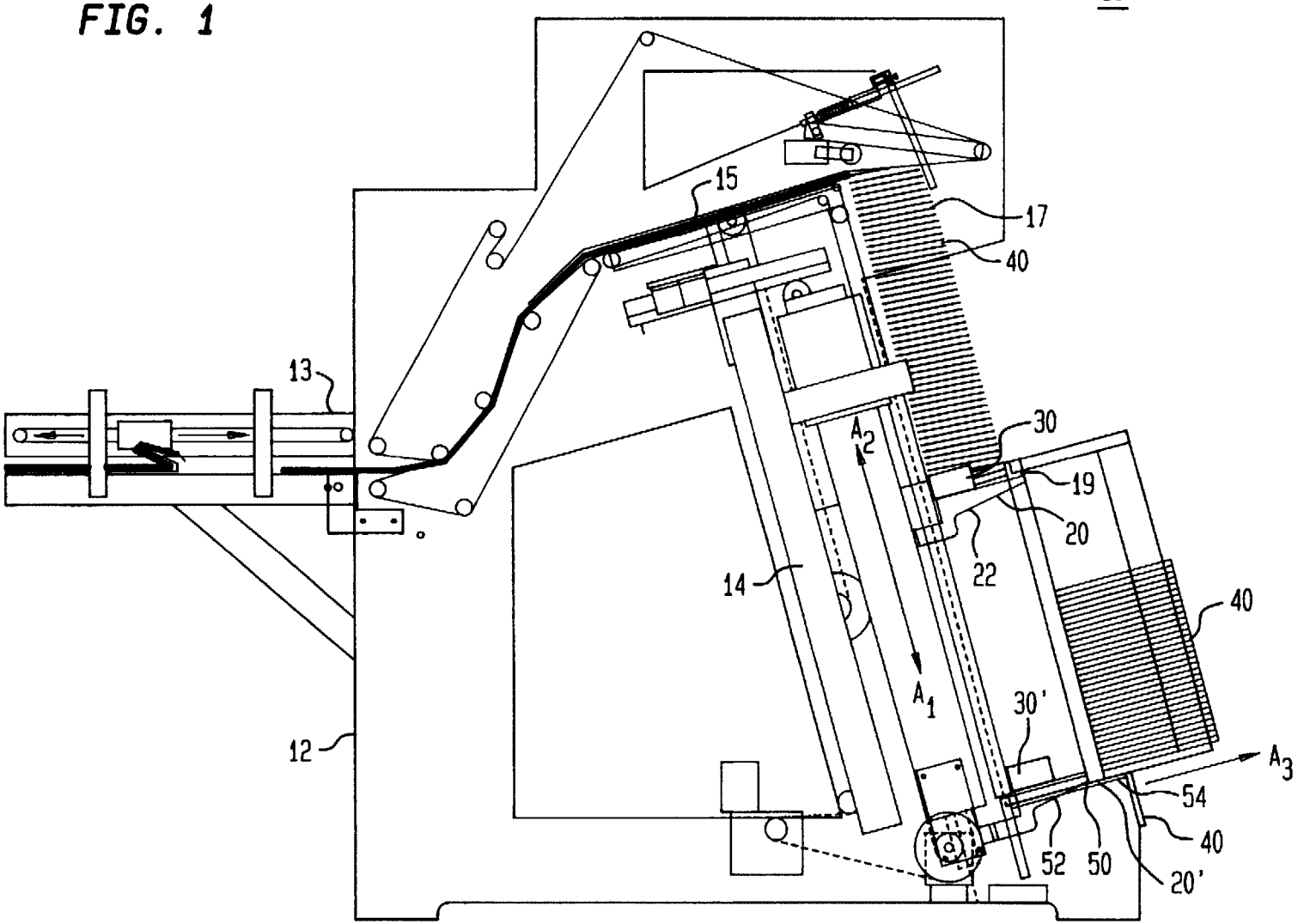
FIG. 1 is a detailed side view of the vertical stacking system of the present invention.

FIG. 1 illustrates a side view of vertical stacking system 10 in accordance with the teachings of the present invention. Frame 12 supports vertical support wall 14. Preferably, vertical support wall 14 is supported at an angle of less than 30° from vertical and most preferably at an angle of 10° from vertical. A conveyor belt 13 feeds signatures 15 to vertical support wall 14 in a similar manner as U.S. Pat. No. 5,460,479, hereby incorporated by reference into this application.

Signatures 15 are received on sliding support assembly 20 for forming a stack 17 of signatures with each successive signature being deposited on a preceding signature. Shelf support assembly 30 supports the bottom edge surface 19 of the bottom signature in stack 17, the details of which are described below. Sliding support assembly 20 and shelf support assembly 30 move downward simultaneously in the direction of arrow $A_1$ until positioned at sliding support assembly 20' and shelf support assembly 30', which is the same assembly of the sliding support assembly and shelf support assembly as shown at the bottom of vertical support wall 14. When stack 17 is formed, sliding support assembly 20 and shelf support assembly 30 slide down vertical wall 14 to sliding support assembly 20' and shelf support assembly 30' to deposit the completed stack on base support 50. Base support 50 defines a base travel path 52 formed of a plurality of base support rollers 54 for transporting the formed signature stack 40 to the next apparatus which can be a conventional bundler, strapper. After transfer of signature stack 40 to the next apparatus, sliding support assembly 20' and shelf support assembly 30' move upward in the direction of arrow $A_2$ for receiving additional signatures.

Figure 2A:
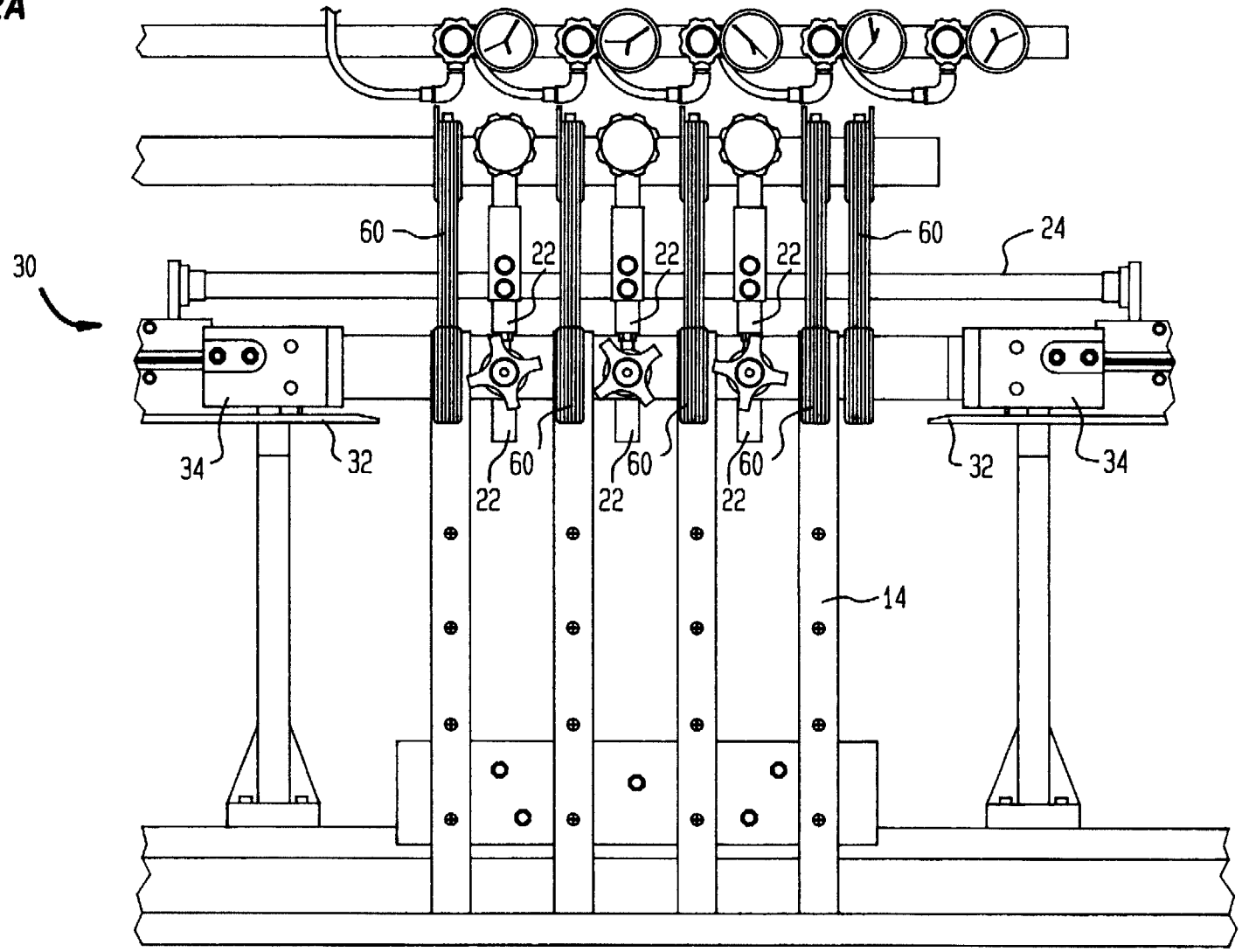
FIG. 2A is a plan view of the retractable forks and sliding shelf assembly in the retracted position.
Figure 2B:
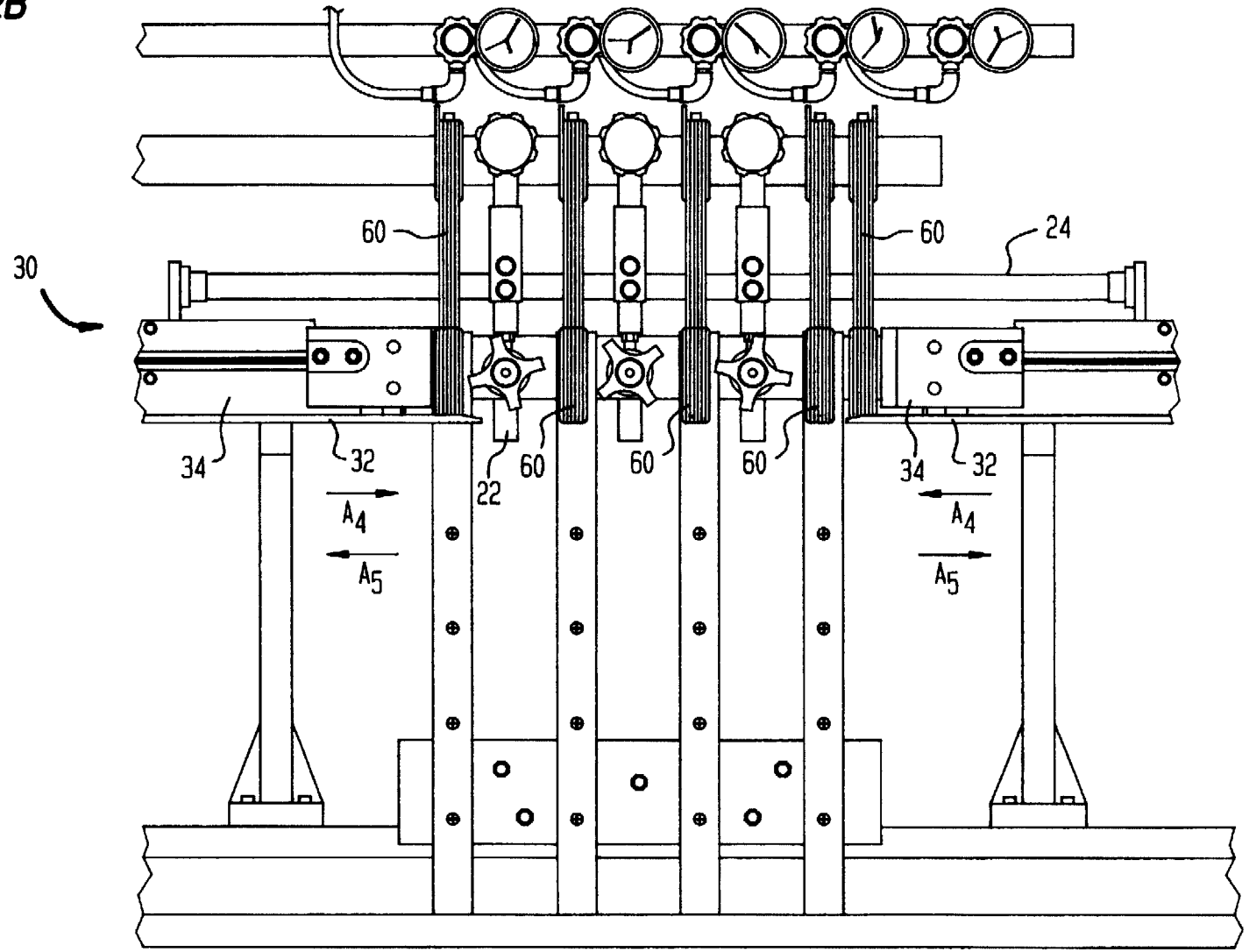
FIG. 2B is a plan view of the retractable forks and sliding shelf assembly in the extended position.

FIGS. 2A and 2B illustrate sliding support assembly 20 and sliding shelf assembly 30 in relationship to belts 60 forming vertical support wall 14. Sliding support assembly 20 includes a plurality of fork prongs 22 positioned between belts 60. Fork prongs 22 are preferably retractable by the movement of piston 24 so that fork prongs 22 can be completely retracted behind the surface defined by the front of vertical wall 14, as shown in FIG. 2B. Shelf support assembly 30 is positioned adjacent belts 60. Shelf support assembly 30 moves in the direction of arrow $A_4$ towards belts 60 and in the direction of arrow $A_5$ as shown in FIG. 2B away from belts 60 for extending and retracting support surface 32 underneath the forming stack of signatures corresponding to the extension and retraction motion of forks 22 in the same reference plane. Support surface 32 provides support of the edge of the bottom surface of the bottom most signature of a formed stack.

Figure 3B:
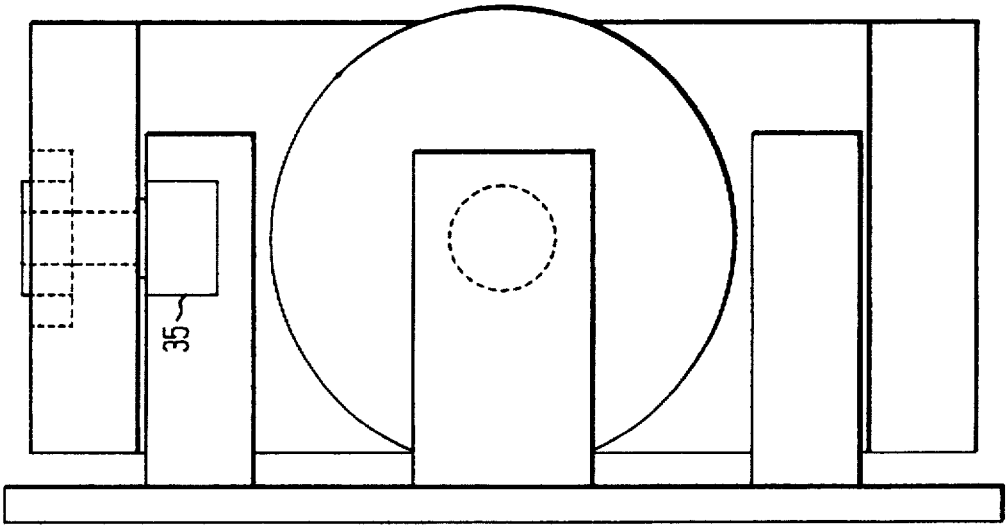
FIG. 3B is a detailed vertical cross sectional view of the cam follower shown in FIG. 3A.
Figure 3A:
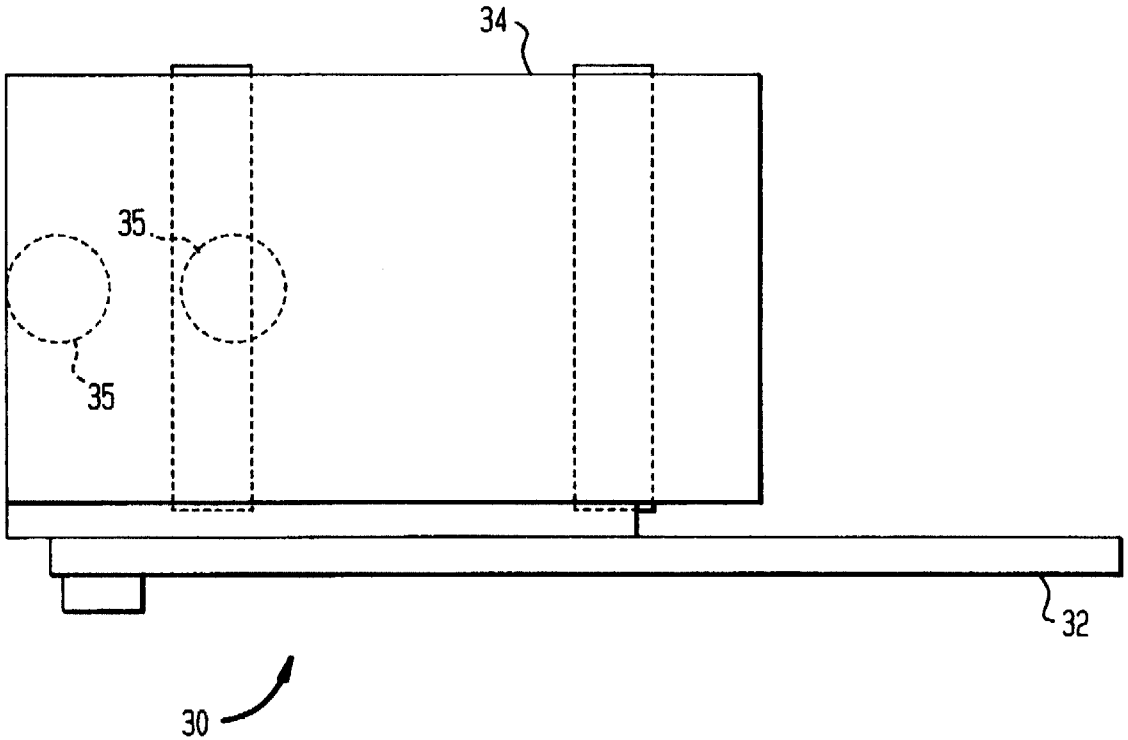
FIG. 3A is a side elevational view of the sliding shelf assembly.
Figure 3C:
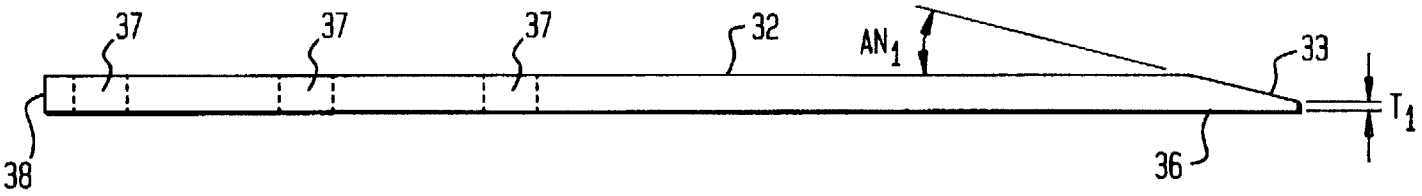
FIG. 3C is a detailed side elevational view of the support shelf shown in FIG. 3A.
Figure 3D:
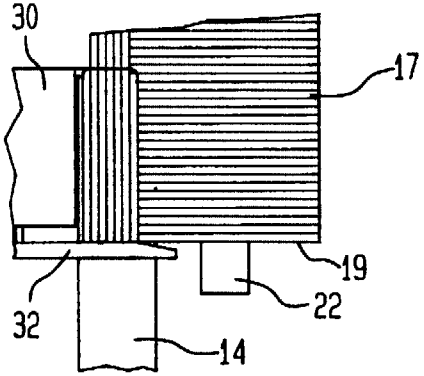
FIG. 3D is a side elevational view of the shelf shown in FIG. 3A supporting a forming signature stack.

Shelf support assembly 30 includes housing 34 for supporting support surface 32, as shown in FIGS. 3A and 3B. Cam follower 35 rotates for moving housing 34 in the directions of arrows $A_4$ and $A_5$. Preferably, support surface 32 includes tapered end 33 at end 36 as shown in FIG. 3C. Tapered end 33 provides a smooth entrance of support surface 32 underneath the bottom signature of the forming stack. Preferably, the angle $An_1$ of tapered end 33, is about 10° to about 30° from the horizontal and most preferably about 15° from the horizontal. Screw holes 37 receive screws (not shown) for mounting support surface 32 to housing 34. FIG. 3D illustrates support of the bottom signature of the stack 17 by sliding support assembly 20 and shelf support assembly 30.

The number of fork prongs 22 and belts 60 used in vertical stacking system 10 are dependent on the width of a signature. For example, a signature having a width of about 11¼ inches preferably can be stacked on a vertical stacking system having three forks and a signature having a width of about 19 inches preferably can be stacked on a vertical stacking system having five forks. For signatures having smaller widths, the stack can be preferably arranged on one or more forks positioned at either the respective right or left sides of vertical stacking machine 10 and additionally supported with shelf support assembly 30 adjacent the respective right most fork or left most fork 22 used for supporting the stack. Alternatively, for larger width signatures supported on all forks 22, a pair of shelf support assemblies 30 can be positioned with one shelf support assembly 30 positioned adjacent the respective left most fork 22 and the other shelf support assembly 30 positioned adjacent right most fork 22.

Figure 4:
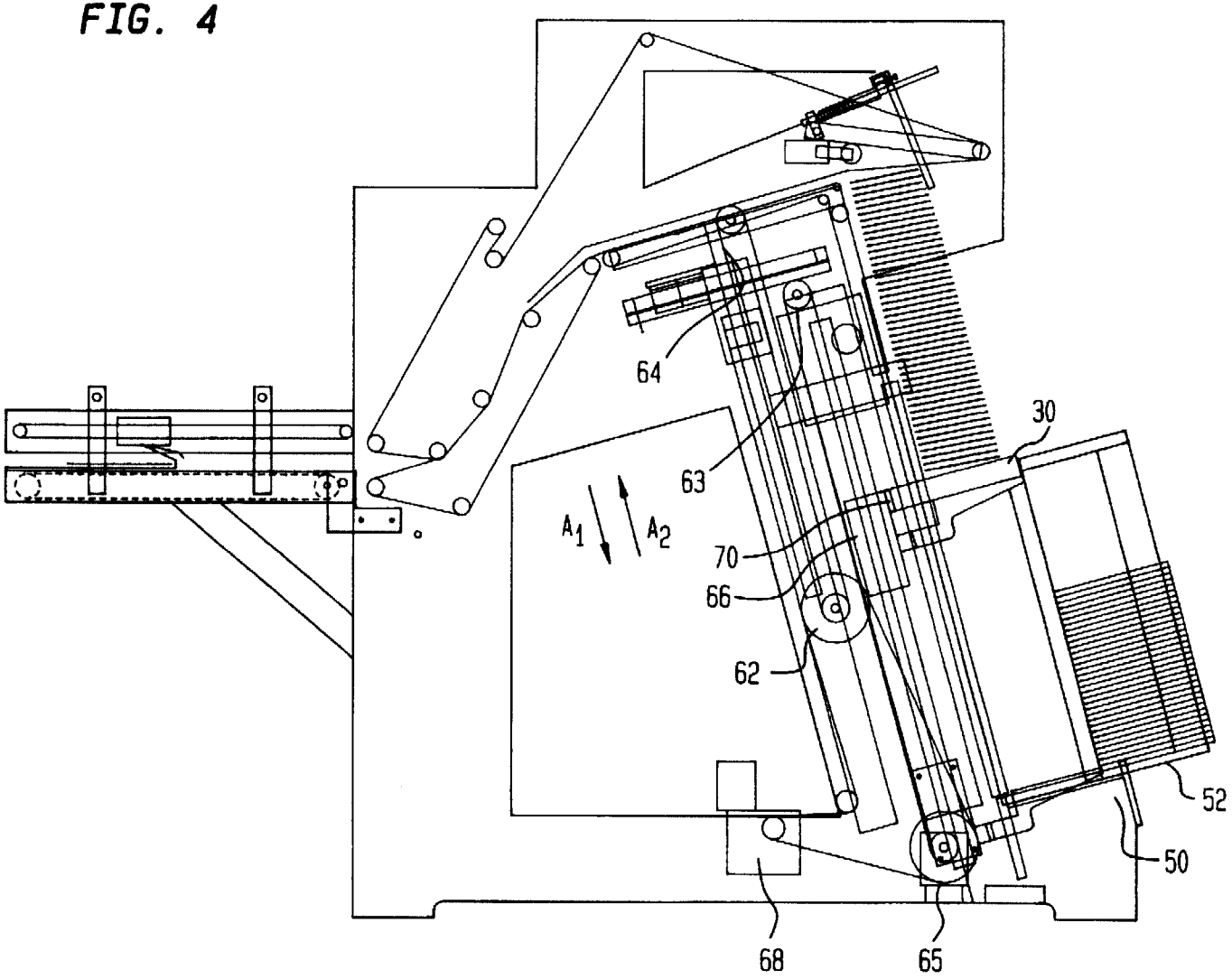
FIG. 4 is a detailed side view showing the carriage for moving the retractable forks and sliding shelf assembly along the vertical wall.

A transport device useful for moving sliding support assembly 20 and shelf support assembly is carriage assembly 66, shown in FIG. 4. A plurality of pulleys 62, 63, 64 and 65 can be activated by solenoid valve 68 for simultaneously moving carriage assembly 66, attached to sliding support assembly 20 and shelf support assembly 30, in the direction of arrows $A_1$ and $A_2$.

Figure 5:
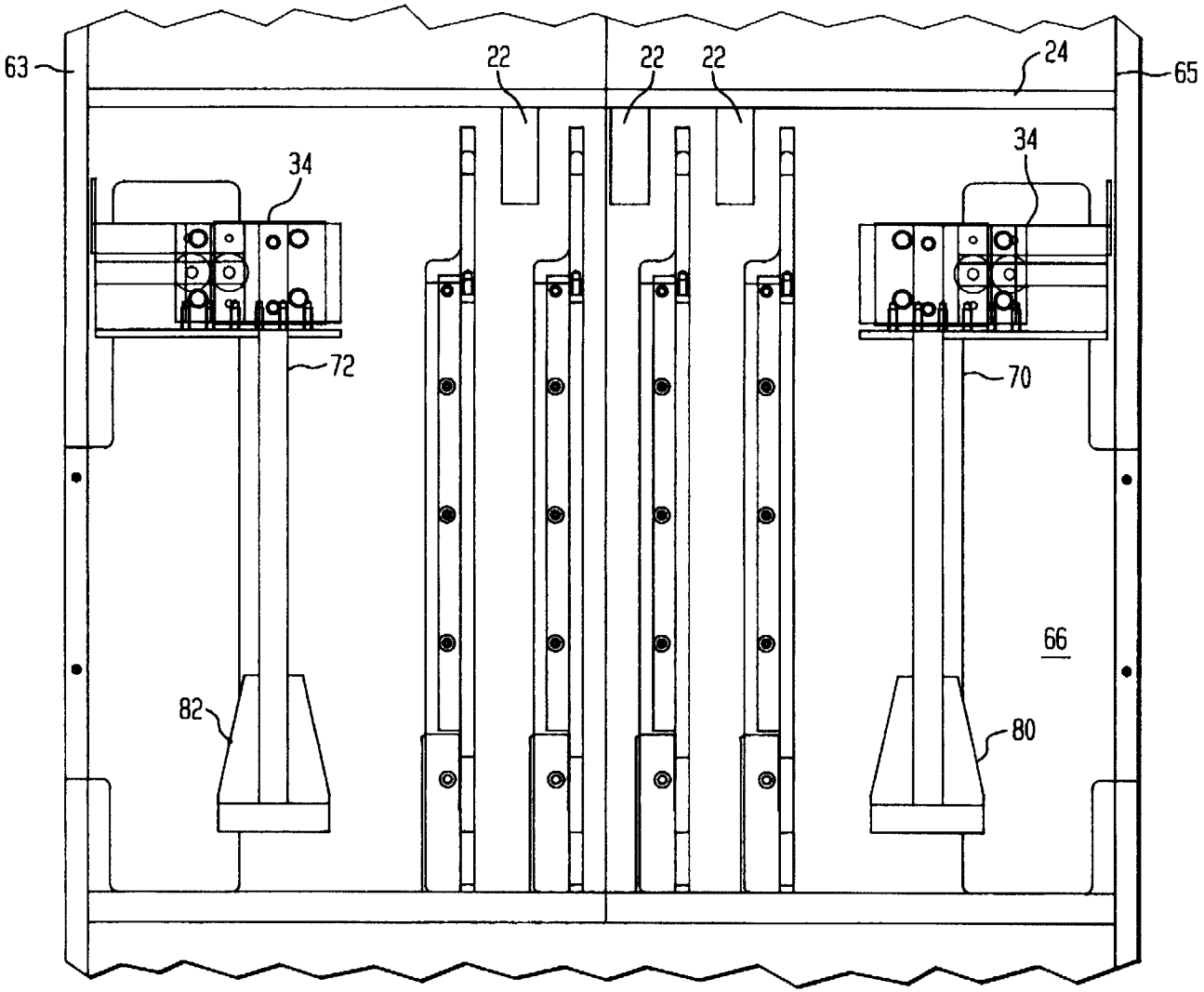
FIG. 5 is a top plan view of the attachment of the support assembly and forks to the carriage.

FIG. 5 illustrates the attachment of sliding support assembly 20 and shelf support assembly 30 to carriage 66. End 70 of support arm 80 and end 72 of support arm 82 are coupled to housing 34 of shelf support assembly 30. Support arms 80 and 82 are coupled to carriage 66. Piston 24 is coupled to sides 63 and 65 of carriage 66.

The present invention has the advantage of providing support for the bottom signature of a stack of signatures in addition to the support provided by the support forks without interfering with the vertical wall and stacking mechanism of the conventional vertical stacking machines. One or two of the shelf support assemblies can be used depending on the width of the signatures.

While the invention has been described with reference to the preferred embodiment, this description is not intended to be limiting. It will be appreciated by those of ordinary skill in the art that modifications may be made without departing from the spirit and scope of the invention.

We claim:

1. A vertical stacking system comprising:

a frame;

a vertical support wall supported by the frame;

sliding support means defining a support plane which intersects the vertical support wall; and first shelf support means positioned perpendicular to said sliding support means in said support plane wherein, said sliding support means supports a stack of signatures thereon and said first shelf support means supports a first bottom edge surface of the bottom signature of said stack of signatures.

2. The stacking system of claim 1 further comprising:

drive means for translating said sliding support means and said first shelf support means along said vertical support wall.

3. The stacking system of claim 2 wherein said first shelf support means comprises:

a support surface; and means for moving said support surface towards and away from a stack of signatures supported on said siding support means.

4. The stacking system of claim 3 wherein said sliding support means comprises:

a retractable fork having a plurality of prongs, the upper surface of which supports said stack of signatures; and means for retracting said fork.

5. The vertical stacking system of claim 4 wherein said means for retracting said fork and said means for moving said support surface operate at the same time so that said plurality of prongs extend and retract from said stack when said means for moving said support surface respectively moves said support surface towards and away from said stack.

6. The vertical stacking system of claim 5 wherein a solenoid valve operates said means for retracting said fork and said means for moving said support surface.

7. The stacking system of claim 6 wherein said first shelf support means further comprises:

a housing, said support surface having a first and second end wherein said first end of said support surface is coupled to said housing and said second end of said support surface is tapered.

8. The stacking system of claim 7 wherein said support surface has a tapered surface which is tapered at an angle of about 10° to about 30° from the horizontal, said tapered surface being positioned adjacent said first bottom edge surface of the bottom signature.

9. The stacking system of claim 8 wherein said support surface is tapered at an angle of about 15° from the horizontal.

10. The stacking system of claim 9 further comprising:

a carriage disposed to travel along said vertical support wall, said sliding support means and said first shelf support means being coupled to said carriage.

11. The stacking system of claim 10 further comprising:

a second shelf support means positioned adjacent a second bottom edge of the bottom signature of said stack of signatures supported on said sliding support means.

* * * * *

UNITED STATES PATENT AND TRADEMARK OFFICE

CERTIFICATE OF CORRECTION

PATENT NO. : 5,788,459
DATED : August 4, 1998
INVENTOR(S) : Irving H. Neumann et al.

It is certified that error appears in the above-indentified patent and that said Letters Patent is hereby corrected as shown below:

On the title page, item [73] delete:

"Assignee: Butler SMC, Somerset, N.J." and insert
--Assignee: Quad/Tech, Inc., Sussex, WI--

Signed and Sealed this

Twenty-sixth Day of October, 1999

*Attest:*

Q. TODD DICKINSON

*Attesting Officer*

*Acting Commissioner of Patents and Trademarks*